United States Patent [19]

Burlando

[11] Patent Number: 5,019,314

[45] Date of Patent: May 28, 1991

[54] PROCESS FOR DIE CUTTING PLASTIC SHEETS

[75] Inventor: Albert A. Burlando, Flanders, N.J.

[73] Assignee: Almetek Industries, Inc., Hackettstown, N.J.

[21] Appl. No.: 809,489

[22] Filed: Dec. 16, 1985

[51] Int. Cl.[5] ..... B26D 3/08

[52] U.S. Cl. ..... 264/156; 264/157; 264/163; 83/39; 83/49; 83/50

[58] Field of Search ..... 264/153, 163, 156, 160, 264/297.1, 297.6, 157; 83/39, 49, 50, 55, 36, 41; 428/43, 42; 425/298

[56] References Cited

U.S. PATENT DOCUMENTS

| | | | |
|---|---|---|---|
| 1,439,393 | 12/1922 | Assmann | 83/50 |
| 2,257,200 | 9/1941 | Smith | 428/43 |
| 2,489,583 | 11/1949 | Messenger | 83/36 |
| 3,198,048 | 8/1965 | Finlayson | 83/36 |
| 3,468,199 | 9/1969 | Hautau | 83/41 |
| 3,475,526 | 10/1969 | Seto | 264/153 |
| 3,523,474 | 8/1970 | Kinslow | 264/153 |
| 3,543,626 | 12/1970 | Macone | 83/55 X |
| 3,703,044 | 11/1972 | Gregory | 428/43 |
| 3,920,122 | 11/1975 | Koehlinger | 156/257 |
| 3,964,354 | 6/1976 | Johannsen | 83/39 |
| 4,043,234 | 8/1977 | Godin et al. | 83/50 X |
| 4,245,414 | 1/1981 | Shypula | 40/124 |
| 4,285,754 | 8/1981 | Dimatteo | 264/153 |
| 4,317,399 | 3/1982 | Romagnoli | 83/50 X |
| 4,330,350 | 5/1982 | Andrews | 156/152 |
| 4,387,127 | 6/1983 | Ogden | 428/42 |

FOREIGN PATENT DOCUMENTS

| | | | |
|---|---|---|---|
| 1181988 | 2/1970 | United Kingdom | 83/320 |

*Primary Examiner*—Jay H. Woo
*Assistant Examiner*—Jeremiah F. Durkin, II
*Attorney, Agent, or Firm*—Louis E. Marn

[57] ABSTRACT

A process for die cutting a sheet of thermoplastic material imprintd with information or data of limited spatial displacement therebetween wherein the data is sequentially die cut in alternating rows and lines in a plurality of registered die cutting stations until all such pieces have been die cut generally in like sizes or pieces and wherein each piece is in residual attachment to the sheet of thermoplastic material.

5 Claims, 4 Drawing Sheets

PROCESS FOR DIE CUTTING PLASTIC SHEETS

BACKGROUND OF THE INVENTION (1) Field of the Invention

This invention relates to a process and apparatus for die cutting a sheet of plastic material, and more particularly to a process and apparatus for die cutting cards including data pieces from a sheet of plastic material including data printed in lines and rows and the card of data pieces produced thereby.

(2) Description of the Prior Art

In the utility and telephone field, many components are provided with an identification marking system for aboveground or underground usage. Such systems were initially developed using metallic tags and metallic information or data pieces, i.e. individual pieces provided with names, symbols and/or alphanumeric information or data. Recently, such identification marking systems have been formed of plastic materials, generally a thermoplastic material, such as polyethylene, polypropylene or mixtures thereof to provide a system effective over extended periods of time exposure to the elements. With such systems, the information or data pieces are die cut from a substrate and placed in compartments of a storage box. Since the pieces are numerous whereas compartments of such a storage box are finite, time is wasted in the selection of predetermined pieces from the compartments. Additionally, wastage is experienced by selection of an unwanted piece and its improper restorage. While such wastage may be minimal, wastage may become greater when using an identification marking system of reduced size.

OBJECTS OF THE INVENTION

An object of the present invention is to provide a novel card of data pieces.

Another object of the present invention is to provide a novel card of data pieces for facile handling and removal of the data pieces therefrom.

Still another object of the present invention is to provide a novel card of data pieces which permit of easy return of unused data pieces to the card.

Yet another object of the present invention is to provide a novel process and apparatus for die cutting data pieces from a sheet of thermoplastic material including data printed in lines and rows thereon.

A still further object of the present invention is to provide a novel process and apparatus for die cutting pieces from a sheet of thermoplastic material including data printed in lines and rows thereof wherein the data pieces have residual attachment.

SUMMARY OF THE INVENTION

These and other objects of the present invention are achieved in a novel process and apparatus for die cutting a sheet of thermoplastic material imprinted with information or data of limited spatial displacement therebetween wherein the data is sequentially die cut in alternating rows and lines in a plurality of registered die cutting stations until all such pieces have been die cut generally in like sizes or pieces and wherein each piece is in residual attachment to the sheet of thermoplastic material, and the novel card of data pieces is residually attached thereto.

BRIEF DESCRIPTION OF THE DRAWINGS

These and other advantages of the present invention will become more apparent from the following detailed description when taken with the accompanying drawings, wherein:

FIG. 10 is an enlarged cross-sectional view of a die cut operation.

DETAILED DESCRIPTION OF THE INVENTION

Figure 1:
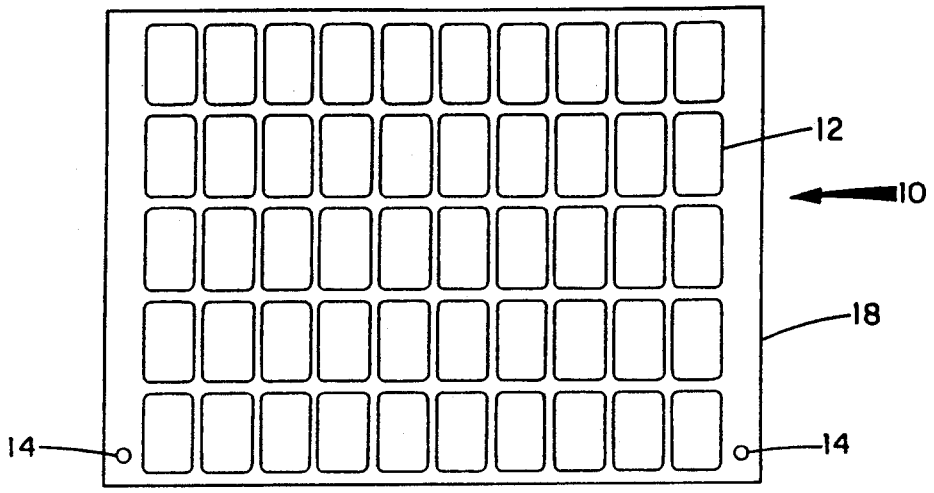
FIG. 1 is a plan view of a card of data pieces as die cut from a sheet of thermoplastic material.

Referring now to the drawings, and particularly to FIG. 1, there is illustrated a card of a thermoplastic material 10 having a plurality of lines and rows of partially excised rectangularly-shaped data pieces 12 on which are printed any desired information or data including symbols, alphanumeric characters, etc., illustrating one embodiment of the present invention. The card of thermoplastic material 10 is formed from a roll (not shown) of a thermoplastic material (not shown), e.g. polyethylene, polypropylene, polyvinyl chloride or mixtures thereof, on which is printed the desired information or data including symbols, alphanumeric characters, etc. in selected area spacing corresponding to lines and rows of the pieces 12 to be subsequently partially excised, as more fully hereinafter described, and including registration orifices 14.

Figure 7:
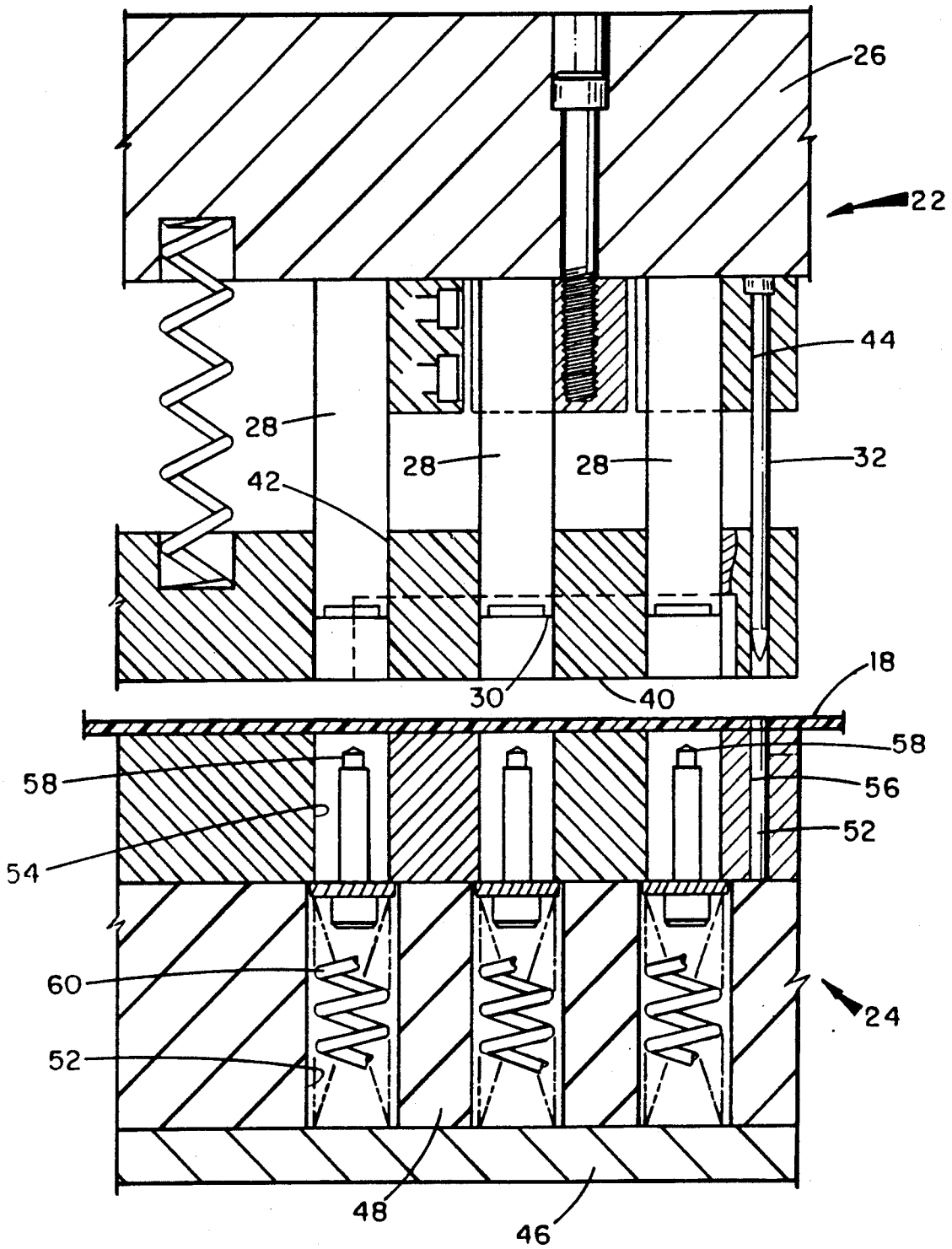
FIG. 7 is a partial cross-sectional view of a die cutting station of a die cutting assembly in an opened position.
Figure 8:
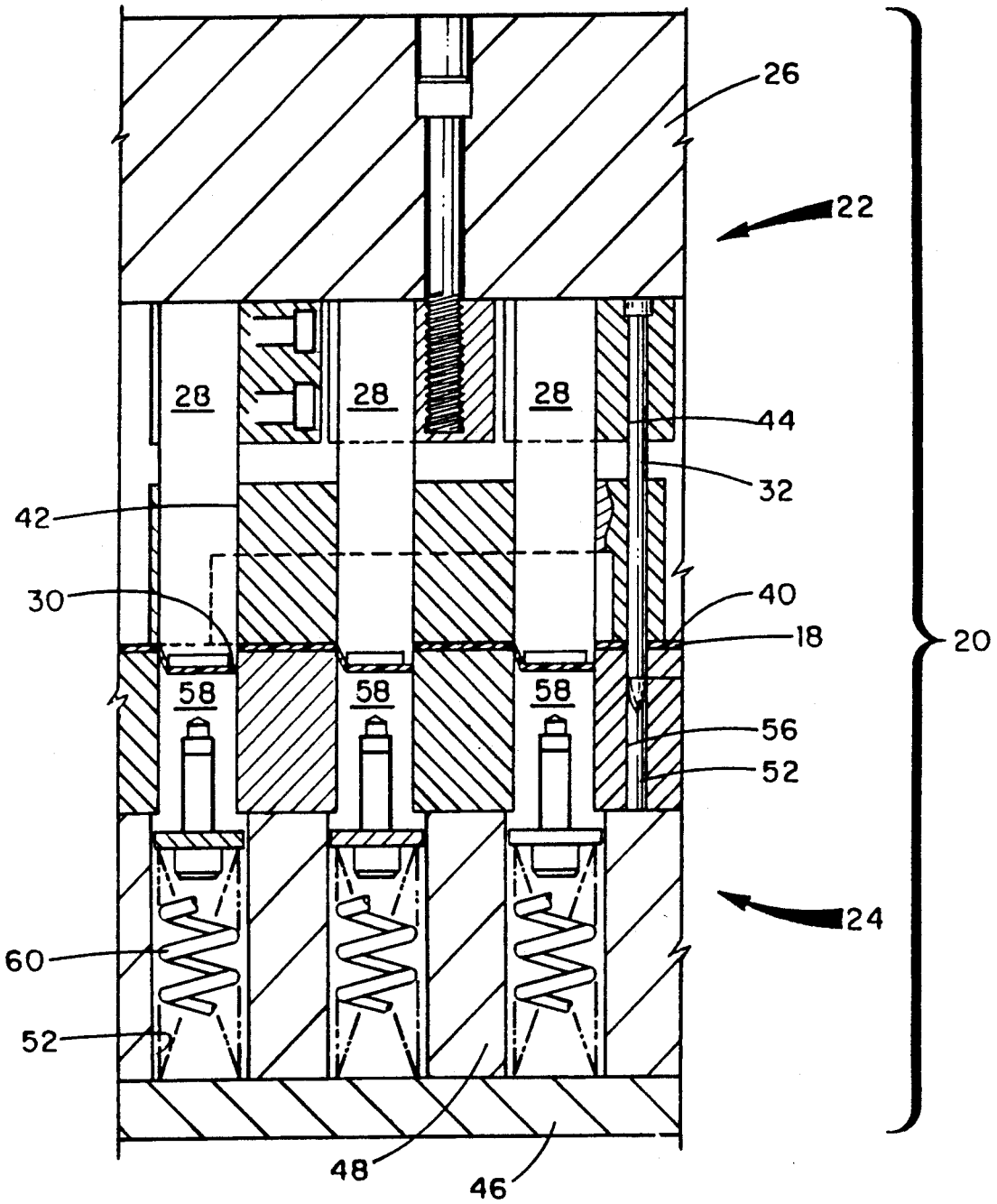
FIG. 8 is a partial cross-sectional view of the die cutting assembly of FIG. 7 in a closed position.

Referring now specifically to FIGS. 7 and 8, a sheet of the roll of thermoplastic material 18 including the printed information and/or data is introduced into a die cutting assembly, generally indicated as 20, and comprised of upper and lower platen assemblies, generally indicated as 22 and 24, respectively, wherein the upper platen assembly 22 is capable of reciprocating vertical movement between an opened position and a closed position, as illustrated in FIGS. 7 and 8, respectively.

The upper platen assembly 22 includes upper platen member 26 to which are mounted a plurality of male die members 28 including rectangularly-shaped die punch portion 30 and a plurality of pilot rods 32 (one shown). The rectangularly-shaped die punch portion 30 of each male die member 28 is preferably formed with longitudinally-disposed slots 34 in corner sections of the rectangularly-shaped die punch portion 30 in edges thereof in the leading edge of each piece in the flow of the sheet 18 of thermoplastic material 18 through the die cutting assembly 20, as more clearly illustrated in FIG. 9. To the upper platen 26 there is mounted by guide members 36 including springs 38 for reciprocal movement, a holding plate member 40 formed with a plurality of die channels 42 and rod channels 44 in which are disposed the male die members 28 and pilot rods 32, respectively.

The lower platen assembly 24 is comprised of a lower plate 46 to which is mounted a plate member 48 formed with a plurality of rectangularly-shaped channels 50 and circularly-shaped channels 52 forming female die orifices 54 and registration orifices 56 at an upper surface of the plate member 48. In the channels 52, there are disposed spring-loaded restraining die members 58 including compression springs 60, as more fully hereinafter described.

It will be understood by one skilled in the art that the upper and lower platen assemblies 22 and 24 are each formed of an essentially unitary die member comprised of a plurality of stations of respective male die members 28 and cooperating female die orifices 54. The sheet 18 from the roll of thermoplastic material on which is printed data is sequentially indexed through the die cutting assembly 20 in incremental widths corresponding to the width of the resulting card of data pieces with the card 10 being cut or severed from the sheet 18 in the station following the last die cutting operation. Referring to FIGS. 2 to 5, if placed in side by side relationship with FIG. 2 at the right, the die stations would illustrate sequential die Stations No. I, II, III and IV with Station No. V being comprised of a smooth surface on both plate members 40 and 48.

It was found that all pieces could not be effectively die cut in one station either as a result of complexity and cost of the required die assemblies and/or resulting distortion to the sheet 18 of thermoplastic material thereby producing an inferior product. Die cutting pieces in alternating lines and rows in sequential die cutting stations produced a highly acceptable product at high production rates with minimal, if any, distorted or malformed cards requiring product rejection.

In operation, referring to FIGS. 7 and 8 and more specifically to FIG. 7, the sheet 18 from the roll (not shown) of the thermoplastic material suitably printed with information or data including registration orifices 14 (as would be illustrated by arranging in one piece the sheets of FIGS. 2 to 5 in sequential alignment) is unrolled into a sheet-wise form and introduced into the die cutting assembly 20 and positioned and clamped in suitable registration with respect to registration orifices 14 in the plate member 48. The sheet 18 of thermoplastic material is indexed from right to left, referring particularly to FIG. 7 to a point where an individual sheet portion (as represented by the distance between registration orifices 14) is essentially in registration or alignment with registration orifices 14 in the plate member 48 whereupon the upper platen 22 is caused to move vertically downwardly towards the lower platen 24.

Initially, the pointed ends of the pilot rods 32 enter the registration orifices 14 formed in the sheet 18 and registration orifices 56 simultaneously causing the clamping action of the clamping assembly (not shown) to be temporarily released to permit the sheet 18 to orient with respect to the full cross-section of the pilot rods 32 within the full cross-section of the registration orifices 14. Continued downward movement of the upper platen assembly 22 causes portions of the holding plate member 40 to contact the sheet 18 and clamp same against the plate member 48. Further downward movement of the upper platen assembly 22 causes the holding plate member 40 to maintain its relative position and clamping force by compression of the springs 38. Downward movement of the upper platen assembly 22 is continued through the point wherein the die punch portion 30 of the male die members 28 pass through the sheet 18 against a force generated via the restraining members 58 by the compression spring 60 to completion of downward movement of the upper platen 22 into a closed position as illustrated in FIG. 8.

Each piece 12 die cut from the sheet 18 is completely excised except for thread-like residual portions 62. It will be understood by one skilled in the art that the residual portions 62 are formed on the leading edge of the pieces 12 formed in the sheet 18 thereby minimizing hanging up of any piece 12 in a female orifice 54 in the lower plate member 46 after die cutting and subsequent indexing of the sheet 18.

Figures 2, 3:
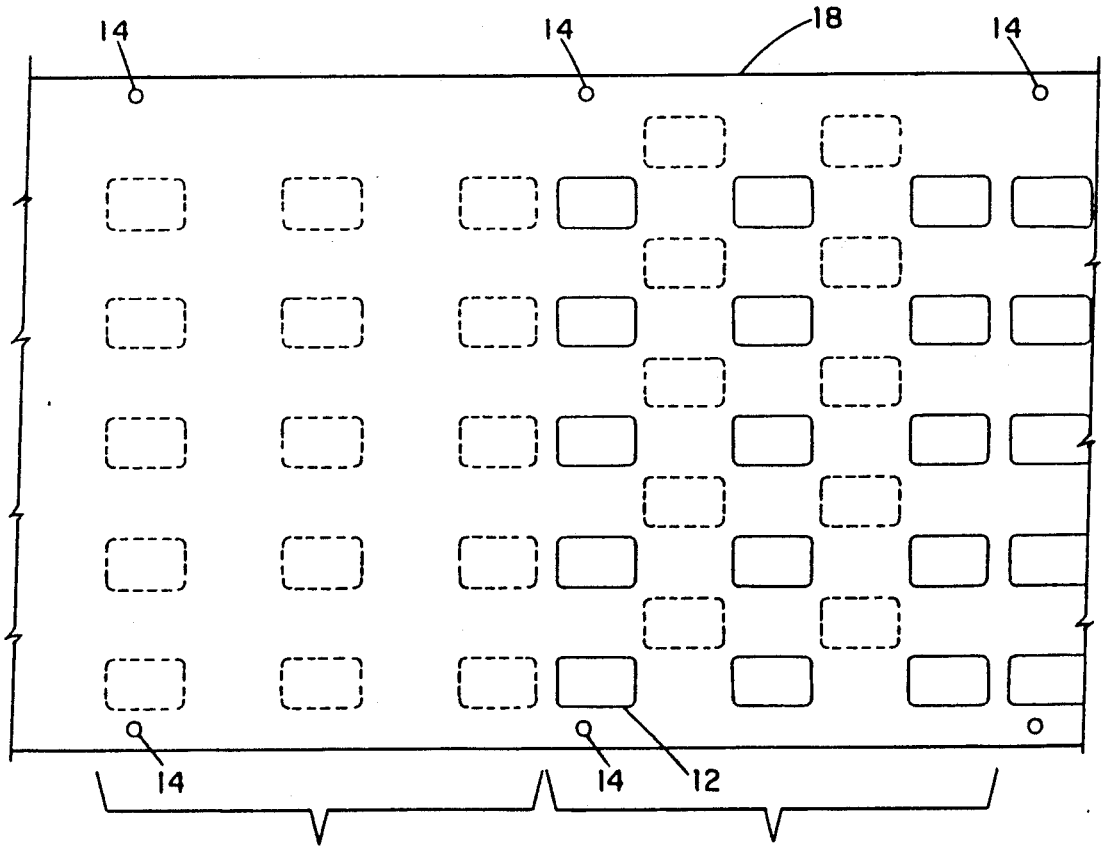
FIG. 2 is a plan view of the sheet of thermoplastic material including printed data in a first die cut station.
FIG. 3 is a plan view of the sheet of thermoplastic material of FIG. 2 in a second die cut station.
Figures 4, 5:
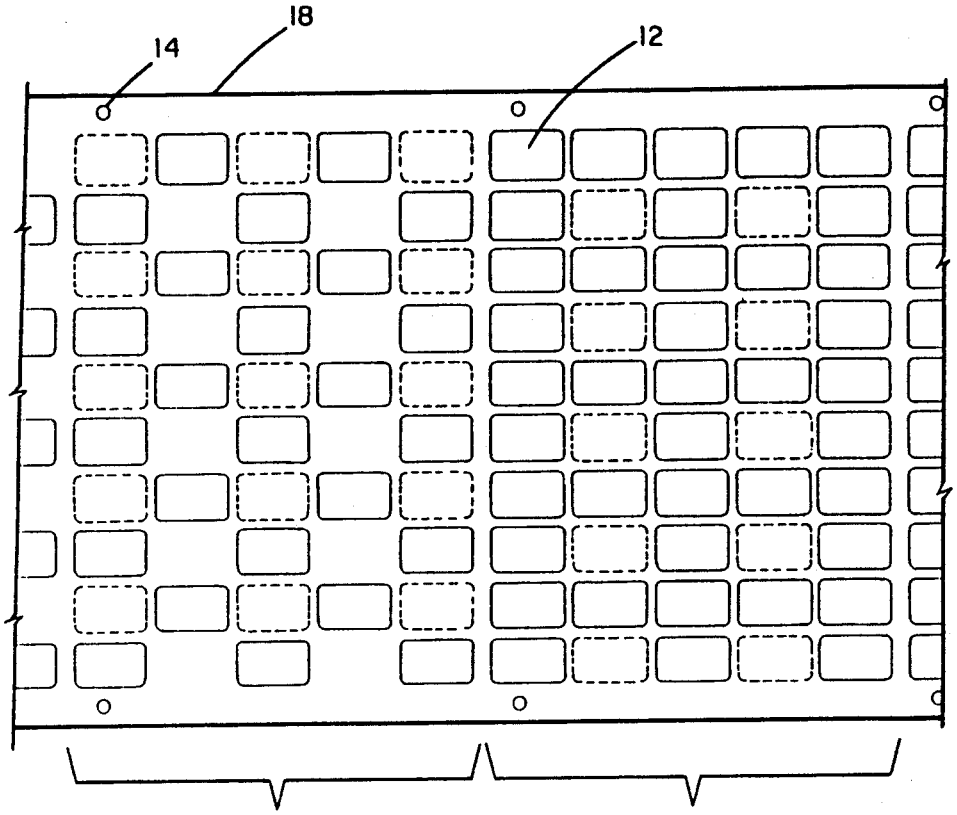
FIG. 4 is a plan view of the sheet of thermoplastic material of FIG. 3 in a third die cut station.
FIG. 5 is a plant view of the sheet of thermoplastic material of FIG. 4 in a final die cut station.

Upon completion of the downward movement of the upper platen 22, the upper platen 22 is thereupon caused to be raised to the open position as illustrated in FIG. 7, whereupon the sheet 18 of thermoplastic material is indexed forward (as illustrated by the arrow) an incremental amount, i.e. linear distance between registration orifices 14 formed in the sheet 18. It is noted that withdrawal of the upper platen 26 permits each die cut data piece to be forced back into the plane of the sheet 18 as a result of the compression force of spring 60 with respect to the female die 54 as the sheet 18 is held against the female die 54 by plate member 40 until the latter clears the sheet 18 during upward movement of the upper platen assembly 22. As hereinabove mentioned, the sheet 18 of thermoplastic material is die cut in a plurality of stations, as illustrated by reference to FIGS. 2 to 5. In FIG. 2, the dotted lines illustrate the configuration of orifices 54 formed in the plate member 48 in Station No. I. After a cycle, i.e. die cutting and indexing, the thus die cut pieces in Station I are illustrated by the solid lines in FIG. 3 where the dotted lines illustrate the orifices 54 in Station No. II, etc., with the like concept similarly illustrated in FIGS. 4 and 5 (Stations III and IV), i.e. FIG. 5 completes the die cutting of all pieces 12.

Generally, a station following Station IV (FIG. 5) is provided where only smooth or flat surfaces are provided on the plate members 40 and 48 to essentially press into the sheet 18 any portion of the pieces 12 excised or die cut prior to discharge from the die cutting assembly 20.

It will be appreciated by one skilled in the art that the string or thread-like residual portions 62 of the excised or die cut pieces 12 minimize the possibility of machine foul-up or the like by essentially preventing a die cut piece to hang up in an orifice 54 of the plate member 48, etc. Additionally, the string or thread-like residual portion 62 of each piece is on a leading edge thereof as the sheet 18 moves from Station to Station, as distinguished from a situation where slots were to be formed in the other corners whereby the leading edge of each data piece 12 would be completely die cut or excised permitting potential entry thereof into a subsequent orifice 54 in the same row.

Figure 9:
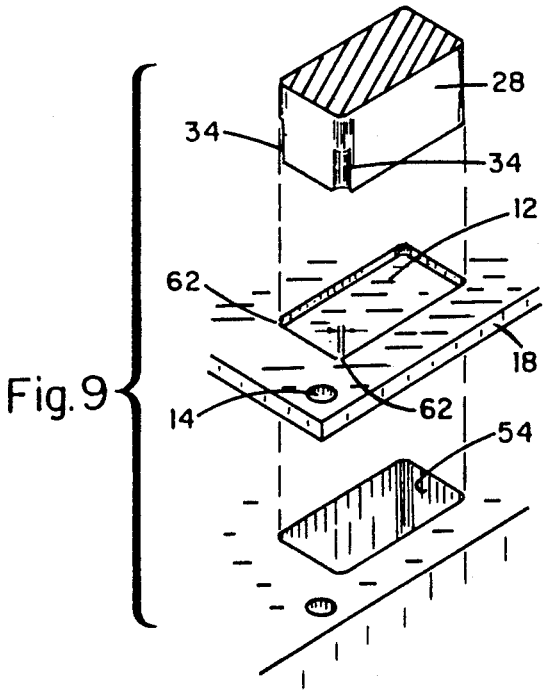
FIG. 9 is an exploded isometric view of a die cutting process.
Figure 6:
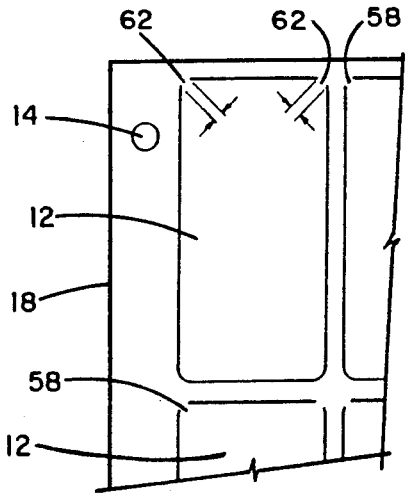
FIG. 6 is a partial enlarged view of the die cut sheet.

During downward movement of the punch portion 30 of the male die members 28 through the plane of the sheet 18 of thermoplastic material and into the respective orifices 54 in the plate member 48, the sheet 18 of thermoplastic material is severed into the corresponding rectangularly-shaped data piece 12, referring to FIG. 9, except for the string or thread-like residual portions 62 thereof corresponding to the corners of the male die members 28 formed with the slots 34. In this manner, each data piece 12 is substantially excised from the sheet 18 of thermoplastic material except for such string or thread-like residual portions 62 to form cards 10 including data pieces 12. Consequently, material integrity is maintained between the card substrate and each data piece 12 which aids in production, storage and usage of the cards 10 and data pieces 12. Thus, instead of producing a plurality of data pieces of small size which would require separate bins for facile use or storage with a limited number of data pieces containing other information, each card 10 need only be stored and accessed to a piece of particular data only requiring a search for a card 10 containing such piece of particular information. Consequently, storage requirements of such pieces of information need only be concerned with selective storage of cards 10 containing such information. Additionally, the existence of such string or thread-like residual portions 62 of material integrity minimizes losses due to storage and handling to a point where the piece of particular information is desired and subsequently selected for piece-wise removal from the corresponding card 10.

Generally, each individual card 10 of data pieces, as illustrated in FIG. 1, is separated from the sheet 18 of the roll in the station following Station No. IV (FIG. 5) wherein all the pieces of information are die cut. In such matter, proper and adequate registration is relatively easy as distinguished from the situation where individual cards 10 are passed through the die cut assembly. One skilled in the art will appreciate the ease and reliability of registration of the sheet 18 from the roll of thermoplastic material as one body or mass as distinguished from registration requirements of individual cards.

While the invention has been described in connection with the exemplary embodiment thereof, it will be understood that many modifications will be apparent to those of ordinary skill in the art and that this application is intended to cover any adaptations or variations thereof. Therefore, it is manifestly intended that this invention be only limited by the claims and the equivalents thereof.

What is claimed:

1. A process for producing a card of date pieces from a sheet of thermoplastic material including preprinted data in repetitive sequential form, which comprises:

(a) introducing said sheet of thermoplasic material including preprinted data thereof into a first station of a plurality of stations of a die cutting assembly including cooperating male and female die members formed in lines and rows, each of said stations including a portion of all of said cooperating male and female die members, one of said die members including a slot;

(b) registering said sheet of thermoplastic material to align said preprinted data with respect to said cooperating male and female die members in each of said stations:

(c) moving said male die members through a plane of said sheet of thermoplastic material and into said female die members to form data pieces having residual attachment to said sheet of thermoplastic material corresponding to said slot of one of said die members;

(d) indexing said sheet of thermoplastic material successively through said plurality of stations and successively repeating step (b) and (c); and (e) successively removing cards of data pieces from said die cutting assembly.

2. The process for forming a card of data pieces as defined in claim 1 and further including the step of forming registration orifices in said sheet of thermoplastic material.

3. The process for forming a card of data pieces as defined in claim 2 wherein said sheet of thermoplastic material including preprinted data is aligned with respect to each of said stations of said die members and further including the step of clamping said sheet of thermoplastic material relative to said die members prior to passing said male die members through said plane of said sheet.

4. The process for forming a card of data pieces as defined in claim 3 wherein each card is die cut from said sheet following die cutting of said data pieces therefrom.

5. The process for forming a card of data pieces as defined in claim 4 wherein residual attachment corresponds to a leading edge of said thus die cut data piece as said sheet advances through said die cutting assembly.

* * * * *